US005946734A

United States Patent [19]

Vogan

[11] Patent Number: 5,946,734

[45] Date of Patent: Sep. 7, 1999

[54] HEAD PROTECTOR APPARATUS

[76] Inventor: Richard B. Vogan, 4275 Berkeley Lake Rd., Duluth, Ga. 30096

[21] Appl. No.: 09/059,084

[22] Filed: Apr. 13, 1998

Related U.S. Application Data

[60] Provisional application No. 60/043,557, Apr. 15, 1997, and provisional application No. 60/058,137, Sep. 8, 1997.

[51] Int. Cl.[6] ..... A41D 20/00

[52] U.S. Cl. ..... 2/412; 2/171; 2/200.1; 2/425; 2/DIG. 11

[58] Field of Search ..... 2/171, 410, 411, 2/412, 414, 425, DIG. 11, 200.1, 209.4

[56] References Cited

U.S. PATENT DOCUMENTS 2,696,007 12/1954 Larkin et al. ..... 2/171
4,947,488 8/1990 Ashinoff ..... 2/411
4,982,451 1/1991 Graham ..... 2/410

*Primary Examiner*—Diana L. Oleksa
*Attorney, Agent, or Firm*—John A. Haug

[57] ABSTRACT

A head protector (10, 10') is shown in certain embodiments, having a plurality of rupturable, closed, pressurized, fluid filled cells (20) each having a rupturable common wall with a low pressure, empty cell (22) between first and second liners (14,16) and with optional cloth inner (18) and outer liners (12). In a second embodiment one or more layers of cushioning material has spaced apart, generally uniformly sized, closed fluid cells (24) intended to withstand selected levels of impacts without rupture. In other embodiments (40, 40', 40", 40'") a cushioning layer of open cell, visco- elastic resin is used with or without a load spreading outer layer of cross-linked, closed cell resin. Fabric covers (46,50) are shown for encapsulating the protector using openable/closable fasteners (48,52).

19 Claims, 8 Drawing Sheets

HEAD PROTECTOR APPARATUS

This application claims the benefit of U.S. provisional application Nos. 60/043,557 and 60/058,137, filed Apr. 15, 1997 and Sep. 8, 1997, respectively.

FIELD OF THE INVENTION

This invention relates generally to protection devices and more particularly to apparatus for protecting a person's head from injury due to a fall, an impact with another person's head or other hard object or the like.

BACKGROUND OF THE INVENTION

Many athletes, such as basketball players or soccer players, engage in their activities without any protection for their heads. As a consequence, head injuries, such as concussions, are not uncommon. By way of example, a basketball player could hit his or her head on the floor, two soccer players could hit their heads together, and so on. While these sports do not seem to necessitate full head protection, such as baseball batter's helmets, football helmets, bicycle helmets, etc., many of the most common head injuries are preventable.

SUMMARY OF THE INVENTION

It is an object of the present invention to overcome the limitations of the prior art noted above. Another object of the invention is to provide a protector which does not obstruct vision or interfere with the game or with other players yet one that provides adequate protection from the most common blunt impacts to the head that occur in sports such as soccer and basketball. Another object is the provision of a protector which is comfortable to wear, one that is washable, or have a washable cover and one which looks appealing to young athletes and feels comfortable to ensure acceptance and use.

Briefly stated, a head protector made in accordance with the invention comprises an elongated member adapted to encircle the head. The member includes a layer of material having a plurality of cells throughout the layer. According to one embodiment, the layer includes a matrix of side-by-side, pressurized, fluid filled closed cell compartments alternating with attached, empty, low pressure, closed cells arranged so that upon sufficient impact the fluid filled compartments will rupture and distribute the energy of the impact. According to another embodiment, closed cells are of generally uniform size, spaced apart, and are all fluid (preferably air) filled, and designed to withstand, without rupturing, a selected level of impact energy. In another preferred embodiment a cushioning layer is formed of open cell resin such as polyurethane foam for energy absorption. This offers the advantage of extra comfort due to its "breathing" characteristic. The layer may be formed all of the same stiffness material or, if desired, in order to provide for a more comfortable, self-adjusting fit, the portion used to protect the front of the head can be formed with a somewhat softer, less stiff material relative to the portion used to protect the back of the head having greater impact energy absorption capability. In a modified embodiment, the open cell layer is provided with a relatively thin outer layer of closed cell material, such as cross-linked polyurethane foam forming a firm but flexible load spreading shell that also minimizes the potential to cause injury to other players.

Additional objects and features of the invention will be set forth in part in the description which follows and in part will be obvious from the description. The objects and advantages of the invention may be realized and attained by means of the instrumentality's and combinations particularly pointed out in the appended claims.

BRIEF DESCRIPTION OF THE DRAWINGS

The accompanying drawings, which are incorporated in and constitute a part of the specification, illustrate a preferred embodiment of the invention and, together with the description, serve to explain the objects, advantages and principles of the invention. In the drawings.

DETAILED DESCRIPTION OF THE PREFERRED EMBODIMENTS

Figure 1:
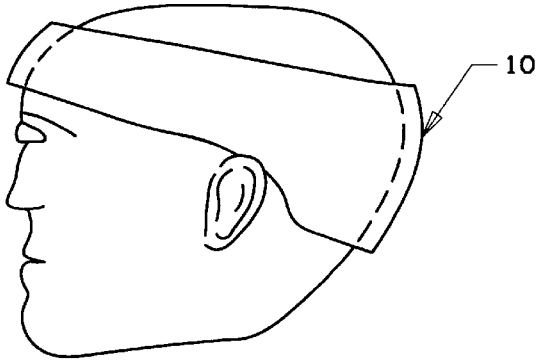
FIG. 1 is a side elevational view of a head protector apparatus made according to the invention shown on a person's head.
Figure 2:
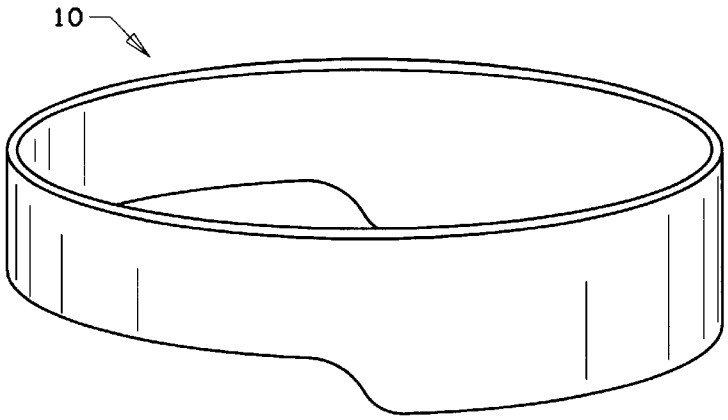
FIG. 2 is a perspective view of the FIG. 1 head protector apparatus showing a member having an endless band.
Figure 3:
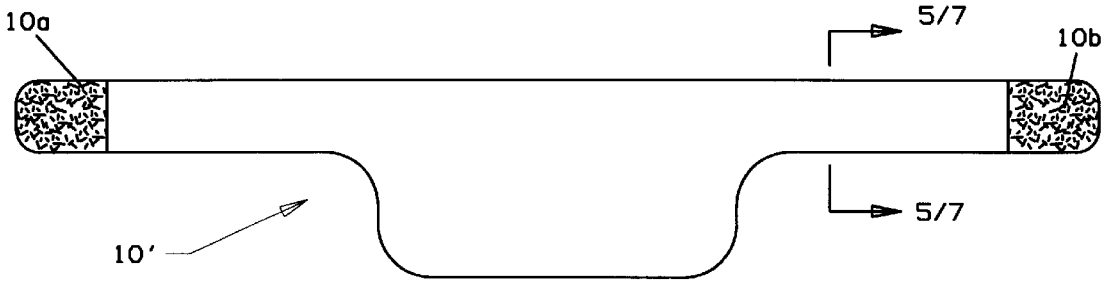
FIG. 3 is a plan view of an alternate form of the head protector apparatus showing an elongated member having opposite ends attachable to one another.
Figure 4:
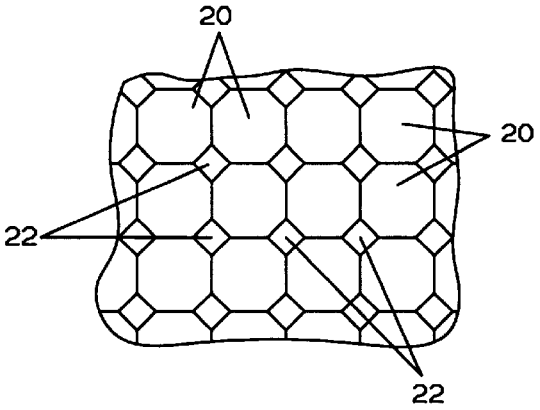
FIG. 4 is an enlarged, broken away, top elevational view of the internal construction of one embodiment of the invention.
Figure 5:
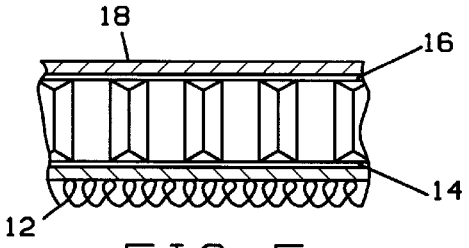
FIG. 5 is an enlarged, cross sectional view taken on line 5—5 of FIG. 3.
Figure 10:
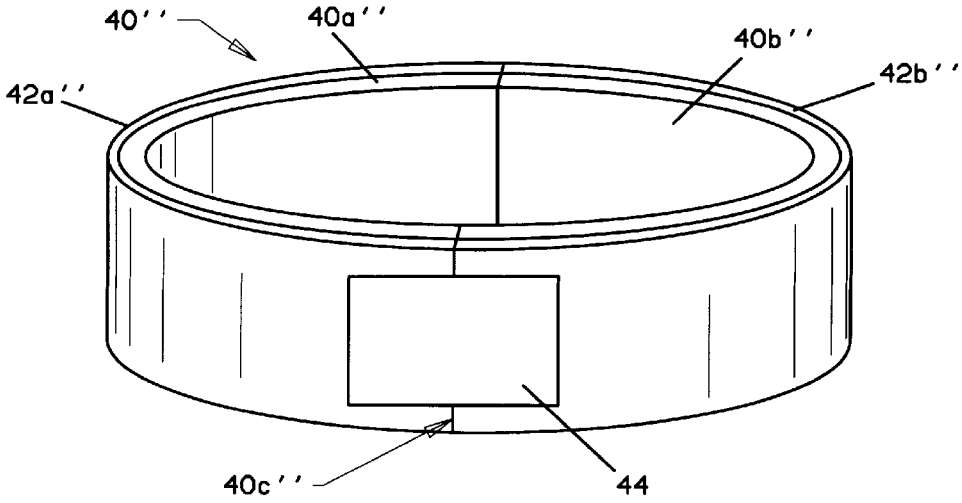

A head protector apparatus 10 of FIGS. 1, 2 and 10' of FIG. 3 made in accordance with the invention has an internal construction designed to partially absorb the energy of an impact thereby providing a cushion against the impact. The head protector comprises an elongated member of flexible material and may be in the form of an endless headband as seen in FIG. 2, a strip with opposite mating ends 10*a*,10*b* having wrap-over hook and loop fasteners such as VELCRO fasteners or the like, as seen for example in FIG. 3 or it may be formed of two separate pieces to be discussed below. According to a first embodiment, the material comprises a honeycomb matrix of pressurized, fluid filled compartments having a rupturable common wall with empty compartments. With reference to FIG. 5, the member is preferably provided with a suitable inner terry cloth cover 18 and opposed gel liners 14, 16 and an outer cloth cover 18. A plurality of fluid filled, pressurized, closed first cells 20 are interspersed with alternating second, smaller, low pressure or empty closed cells 22 (FIG. 4). The common walls between cells 20 and 22 are formed so that upon a heavy impact, such as the head hitting the floor, the common walls between the fluid filled cells or compartments would rupture allowing the fluid to enter into the empty compartments thereby distributing the energy of the impact and maintaining a cushion between the head and the floor.

Figure 6:
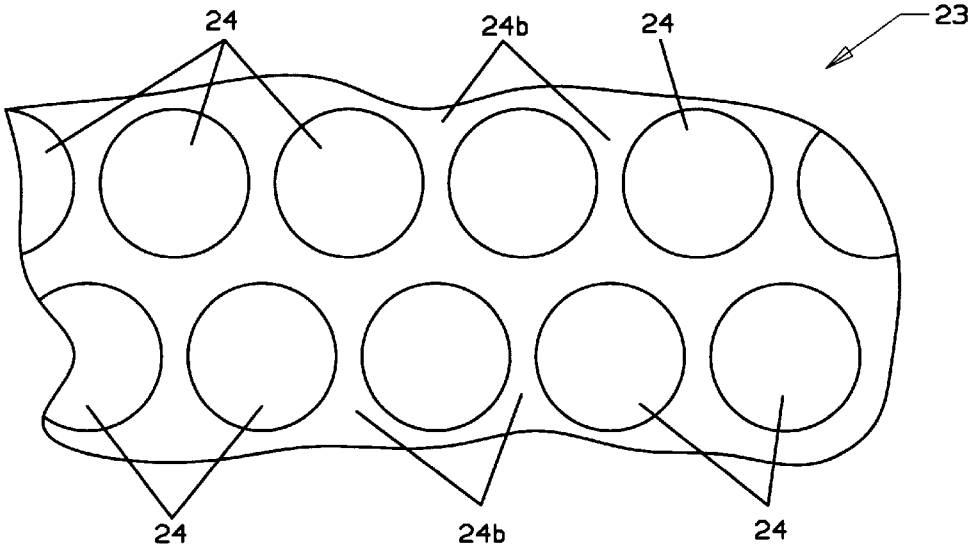
FIG. 6 is an enlarged, broken away view, similar to FIG. 4, of the internal construction of the protector apparatus according to a second embodiment of the invention.
Figure 7:
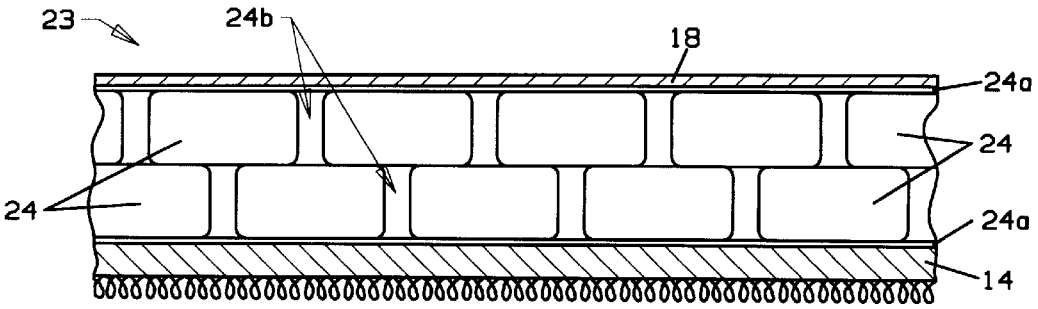
FIG. 7 is a cross sectional view taken in line 7—7 of FIG. 3, FIGS. 8–11 are perspective views of alternate embodiments of two piece head protector apparatus made in accordance the invention.

With reference to FIGS. 6 and 7, a head protector 23 made in accordance with a second preferred embodiment of the invention comprises a plurality of generally uniformly sized, spaced apart, closed, fluid (preferably air) cells 24 formed of suitable flexible plastic material. FIG. 6 shows two layers of cushioning material and comprises a plastic film backing 24*a* having cells 24 spaced apart as shown at 24*b*. The particular size of the cell and thickness of the plastic material is selected to provide a desired level of cushioning or displacement without rupturing. Suitable material, such as heavy duty 3/16" cushioning material is available from Sealed Air Corporation and distributed under the trade name Air-Cap.

Based on an assumption that an impact to the head of a blunt object will be distributed over several square inches of cushioning material, 2–4 layers of such material may be used to provide the internal construction of the head protector cushioning member. The protector may utilize a greater number of layers (or total thickness) in the portion of the protector adapted to protect the back of the head than used in the portion of the protector adapted to protect the front and sides of the head since blows to the front and sides of the head are typically cushioned, at least in part, by other parts of the body prior to impact of the head (hands, arms shoulder, nose and the like). It will be realized that when multiple layers are employed, the size of cells 24 in one layer may be the same or of a different size than the cells 24 of another layer.

The terry cloth cover, or similar material, removable, if desired for washing or change in color or the like, while being optional, provides a more comfortable feel and could be made stylish and decorative, e.g., could be decorated with popular or school team logos and colors.

Figure 8:
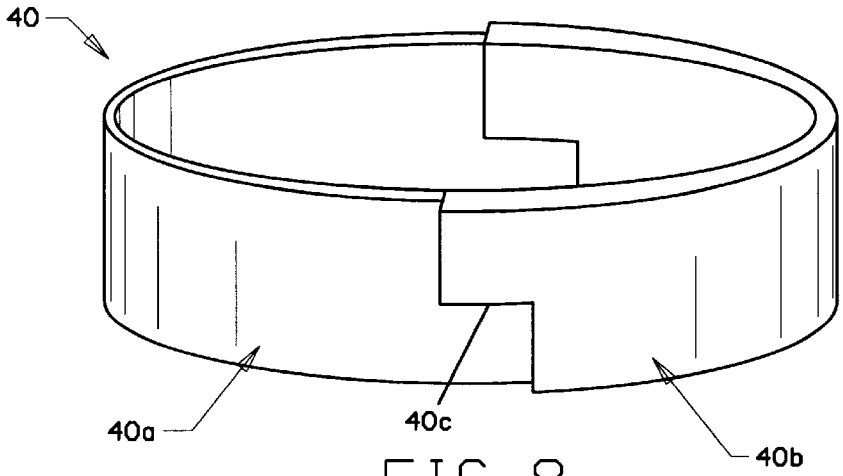
Figure 13A:
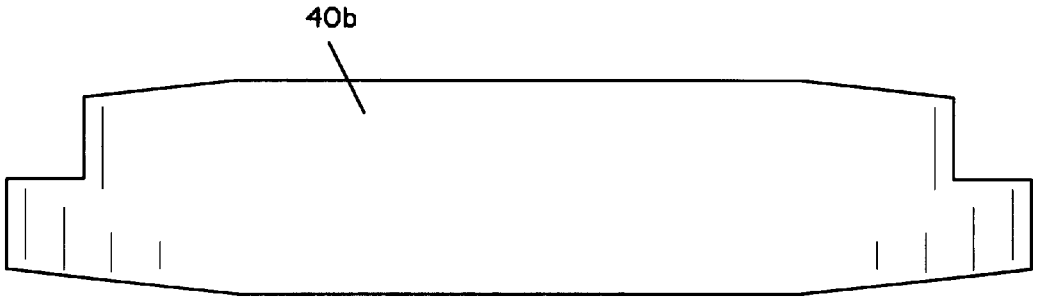
FIGS. 13*a* and 13*b* are plan views of back and front sections of another two piece head protector apparatus.
Figure 13B:
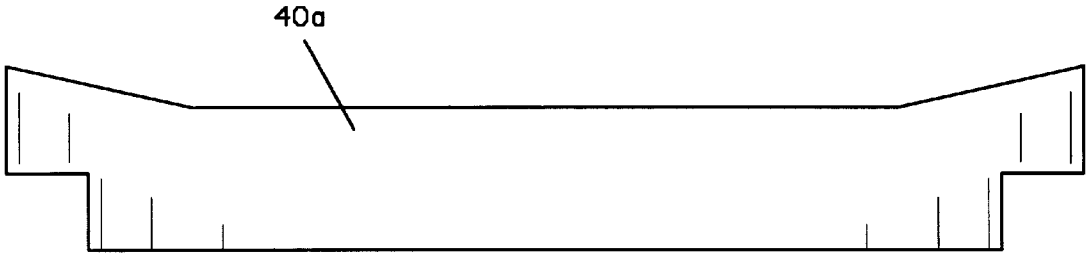

With reference to FIG. 8 a head protector 40 made in accordance with another embodiment of the invention comprises an elongated member made up of a visco-elastic resin, such as open cell polyurethane Confor Foam available from EAR Specialty Composites, in various stiffnesses, e.g., CF47, a less stiff CF45 and a still less stiff CF42. The open cell foam "breathes" thereby providing improved comfort while the visco-elastic properties provide excellent energy absorption and is easily compressed for a snug fit without a substantial loss of cushioning. By conforming to the size and shape of the wearer's head, the head protector made in accordance with the invention can be made in a small number of standard sizes. Although protector 40 can be provided as a single, endless member, as shown, a two part protector comprises a front portion 40*a* and a rear portion 40*b*. In the preferred embodiment, a softer, less stiff type of foam, such as CF45 or CF42, is used in the front portion of the head protector for a more comfortable, self-adjusting fit within each standard size. The firmer CF47 foam is used for the rear portion for greater impact energy absorption. The size of the front portion is preferably 2 inches or less in height and from 5/8 to 3/4 inches in thickness while the rear portion is typically taller, 3 inches or less and thicker, 3/4 to 1 inch. The two portions may be formed with an offset seam 40*c* or may be formed without an offset as shown by straight seam 40*c*' in FIG. 9. The offset version allows for expansion in a convenient manner as well as minimizing the number of different sizes required. The two portions preferably are formed so that they are joined above the ears on each side of the head. The thickness of the front and back portions can be tapered along the side portions, if desired, to form a flush joint or seam. A suitable pattern for forming the FIG. 8 member is shown in FIGS. 13*a*, 13*b*.

Figure 9:
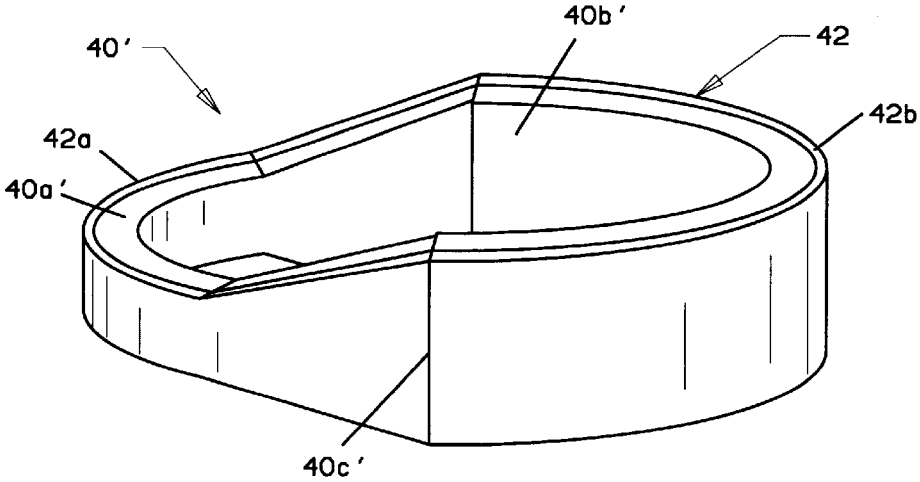
Figure 12A:
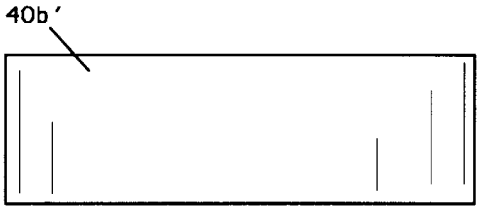
FIGS. 12*a* and 12*b* are plan views of back and front sections of a two piece head protector apparatus.
Figure 12B:
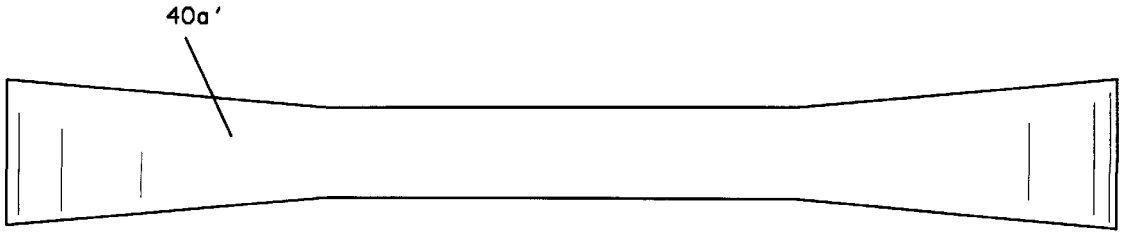

FIG. 9 shows a head protector 40' having an additional outer layer 42 formed of a firm but flexible load spreading shell such as a closed cell, cross-linked polyurethane or other similar resin that will also minimize the potential to cause injury to other players. One such material is a cross-linked polyurethane foam known as Plastazote available from KristoFOAM. It is available in various densities, such as HD60 and HD80 (more dense). By way of example, the front portion 40*a*',42*a*, is approximately 1 3/4 inch in height with portion 40*a*' being a relatively soft foam approximately 1/2 inch in thickness and portion 42*a* being the same height and approximately 1/4 inch in thickness. Rear portions 40*b*', 42*b*, are approximately 2 3/4 inch in height and 1/2 to 3/4 inch in thickness for portion 40*b*' and 1/4 inch for portion 42*b*. The height on the sides of the portions tapers to provide a continuous smooth edge, as shown in FIG. 12*a*, 12*b*, which shows the inner cushioning portions as laid out, that is, prior to forming into a loop configuration. The outer layer material, such as HD60 foam is attached in any suitable manner as by being laminated or glued to the open cell foam and die cut into one or two sections. Fabricating the cushioning material in two sections allows different thicknesses and stiffnesses of cushioning material for the front and back as noted. The cushioning material will then be permanently taped, heat welded (butt welded) or otherwise fabricated to form an endless band. For example, a permanent, polypropelene label 44 with a strong, pressure sensitive adhesive backing may be used to tape a seam as shown in FIG. 10.

Figure 11:
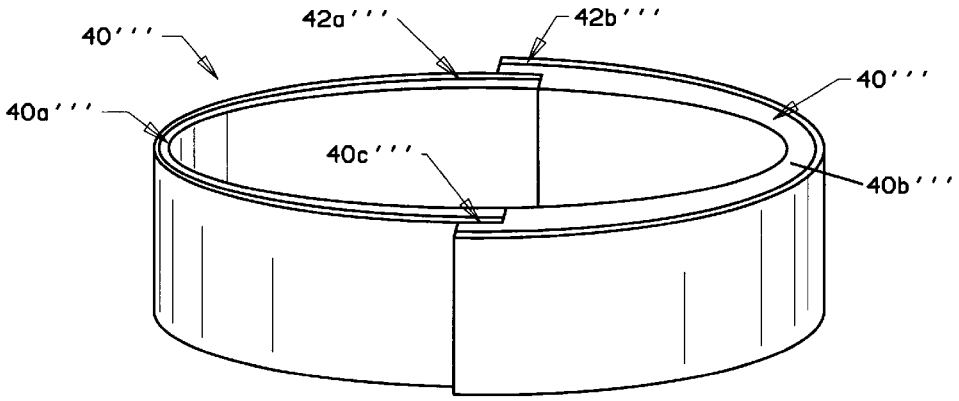

Another variation is shown in FIG. 11 in which a side-by-side overlap 40*c*'''. In FIG. 11 head protector 40''' has front portions 40*a*''' of 5/8 to 3/4 inch in thickness and portion 42*a*''' of 1/8 to 1/4 inch in thickness and a height of 1 3/4 to 2 inches and rear portion 40*b*''' has a thickness of 3/4 to 1 inch with portion 42*b*''' of 1/8 to 1/4 inch and the rear portion 2 3/4 to 3 inches or less so that it covers a larger area in the back.

If desired, the fabric exterior can be eliminated and the firmer closed cell material utilized as the exterior. As noted above, it is undesirable for the outer shell to be so rigid that it could injure or cut an unprotected area of other participants in the particular activity. Therefore, only a relatively firm but flexible material is desirable. The external shell could be molded or otherwise fabricated in a variety of shapes and colors. Using an open cell material such as the Confor foam for the inner layer offers comfort and moisture absorption and an internal fabric can be attached using Velcro or other fasteners to provide additional comfort and a washable liner.

Figure 14A:
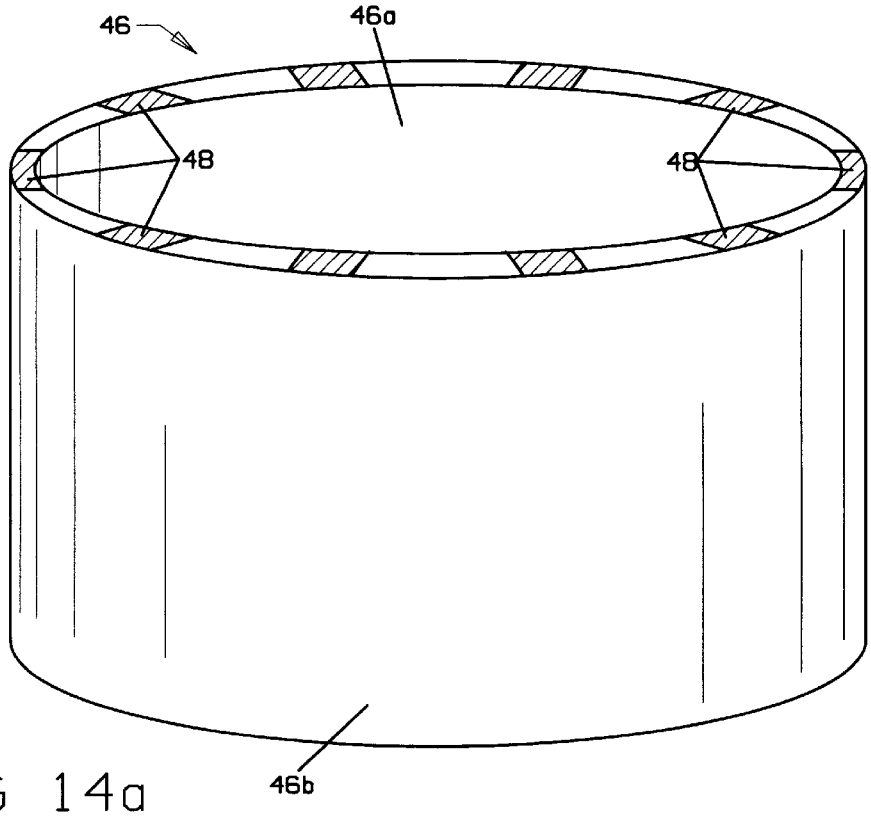
FIG. 14*a* is a perspective view of a cover for use with the head protector apparatus according to the invention and FIG. 14*b* is a plan view of the FIG. 14*a* cover prior to folding.
Figure 14B:
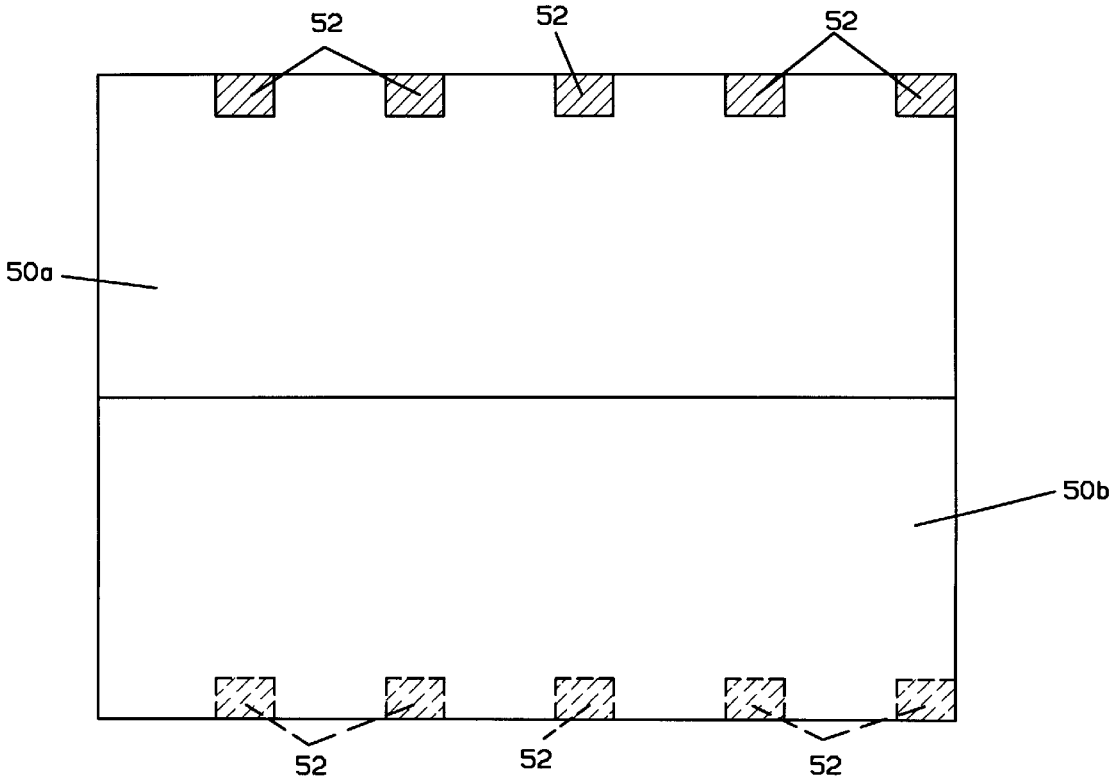

With regard to a removable, washable fabric cover for the head protector, if one is desired, any suitable material can be utilized such as cotton/elastic "sweatband" materials, stretch nylon or cotton knit material such as used for baseball or cheerleaders socks and various cut and sew combinations of materials as described above. Typically, any of these alternates would have a reclosable opening to allow for removal of the cushioning material as needed in order to wash the cover, change to a different color, such as for home and away uniform colors, and the like. The closure could be partly sewn with a final closure using VELCRO, snaps or other suitable fasteners. Another alternate is to have a cover similar to a sock that is open at both ends. The cushioning material would be placed in the cover, then one end of the "sock" would pull over the other end to make a complete circle. The ends can be held in place with fasteners as described above or by a wrap around VELCRO band to hold it firmly in place. Such wrap around band can also secure the connection where the separate pieces or ends of the cushioning material are joined into a circle. Two examples of a suitable cover are shown in FIGS. 14*a*, 14*b*. In FIG. 14*a*, cover 46 in the form of a tube having an interior surface 46*a* of a first color and an exterior surface 46*b* of a second color. VELCRO, or other suitable fasteners 48, are attached at opposite ends so that the tube can be wrapped around the protector in either direction to expose the desired color with the ends fastened together by fasteners 48. In FIG. 14*b* cover 50 is provided with a generally rectangular piece of stretchable material having a top portion 50*a* of a first color and a bottom portion 50*b* of a second color. Fasteners 52, such as VELCRO, are provided on opposite face surfaces of the piece of material at opposed ends thereof so that the piece can be folded over the protector with either portion 50*a* or 50*b* exposed with the piece fastened together by fasteners 52.

Figure 15A:
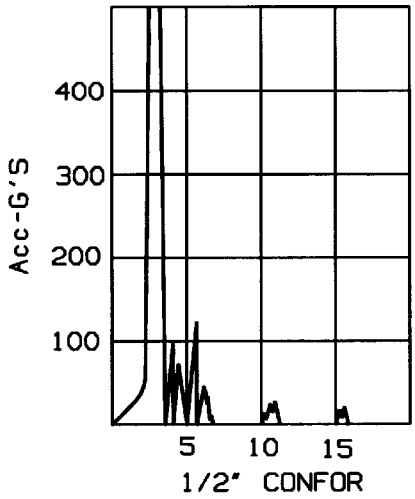
FIGS. 15*a*–15*h* are graphs showing results of tests conducted on selected head protector apparatuses.
Figure 15B:
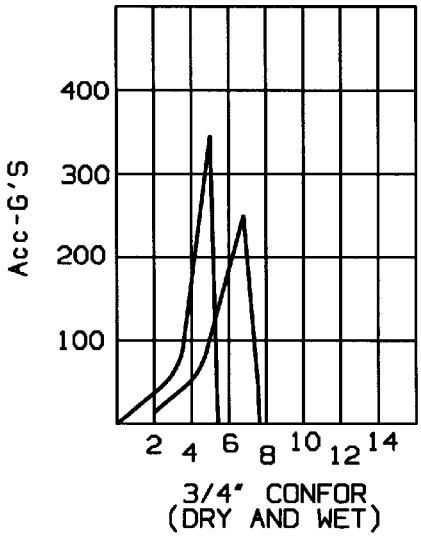
Figure 15C:
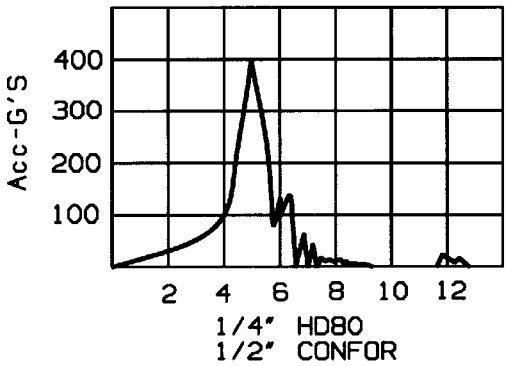
Figure 15D:
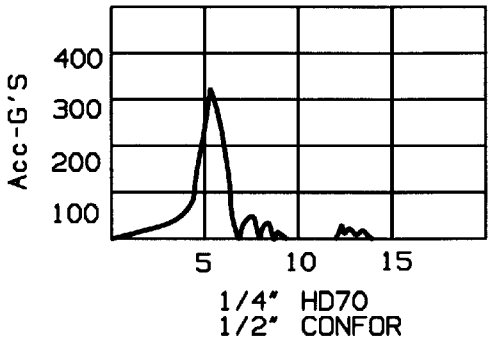
Figure 15E:
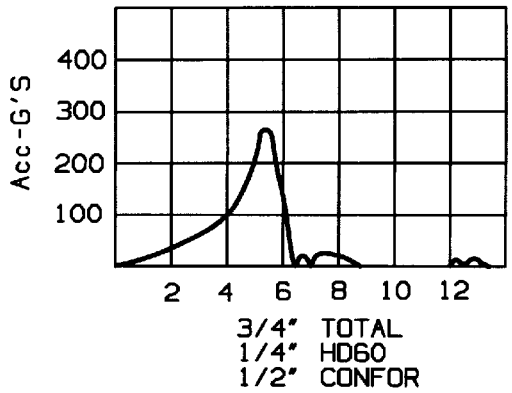
Figure 15F:
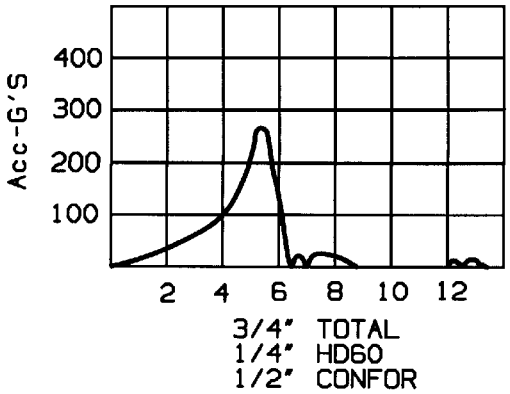
Figure 15G:
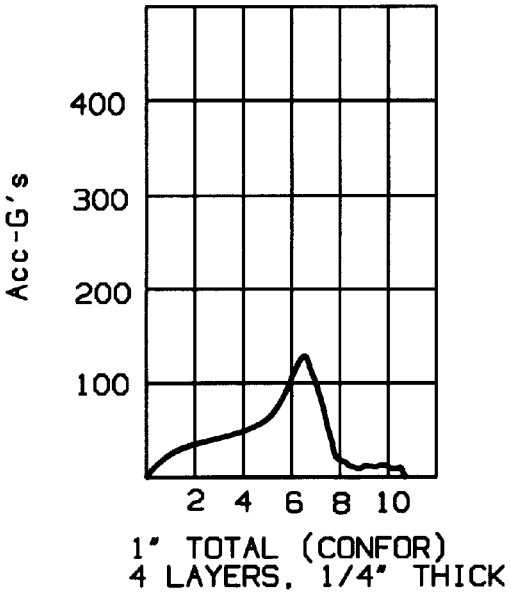
Figure 15H:
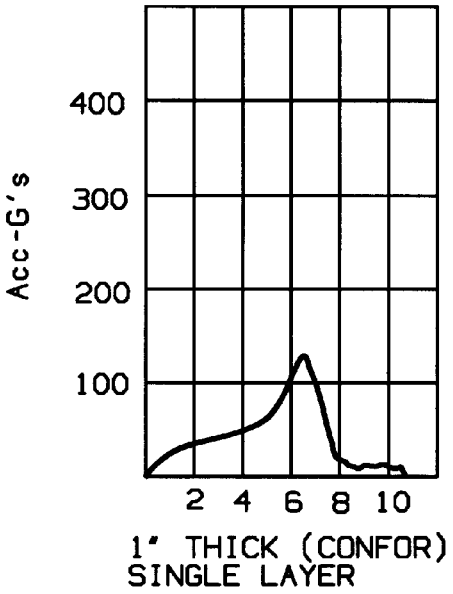

Several different materials referenced above relative to the embodiment of FIGS. 8–12 were tested using a 5.5 Kg mass released approximately 0.98 meters in free fall to obtain approximately 50 joules. As shown in FIG. 15*a* a ½ inch thick open cell foam (CF47) passed through more than 500 Gs and was therefore unacceptable. The results of a ¾ inch thick foam of the same stiffness is shown in FIG. 15*b* with curve 15*b*1 showing between 300–400 Gs representing dry foam and curve 15*b*2 representing foam of the same thickness and stiffness but saturated in water transmitting between 200–300 Gs. However the saturated foam did not recover its original shape after several tests. FIG. 15*c* shows the result of an inner layer of ½ inch CR47 foam with an attached outer layer of ¼ inch closed cell HD80 which passed through approximately 400 Gs. FIGS. 15*d*–15*h* all show results passing through 300 or less Gs. FIG. 15*d* relates to a ½ inch inner layer of CF47 with an outer layer of ¼ inch LD70, FIG. 15*e* relates to ½ inch layer of CF47 foam and ¼ inch outer layer of HD60. FIG. 15*f* relates to a ½ inch inner layer of CF47 foam and an outer layer ¼ inch HD60 load spreading material and FIG. 15*g* relates to four layers of open cell material each ¼ inch. FIG. 15*h* shows the results of a single layer of CF47 foam of 1 inch thick and shows a relatively flat curve peaking at approximately 100 Gs.

Since all the samples except for the single 1 inch layer of FIG. 15*h* used 0.25 inch CF47 foam glued together in layers, a sample of 4 layers of 0.25 was tested for comparison. This sample, FIG. 15*g*, registered 158 Gs at a maximum with some peaking indicating that the results of the layered samples can be considered a worst case for a particular thickness. Another comparison was made to show the improvement from the load spreading shell. Three layers of 0.25 inch CF47 foam registered approximately 350 Gs at its maximum and was sharply peaked (curve 15*b*1). Two layers of 0.25 inch CF47 foam with one layer of 0.25 HD60 as a load spreader registered approximately 250 Gs at its maximum and was somewhat less sharply peaked (FIG. 15*g*).

The above results show that a total thickness of ¾ inch, using a combination of open cell foam and closed cell, cross-linked performs effectively. Some users may desire a more optimal 1 inch total thickness, especially those whom have had previous head injuries.

Although the invention has been described with regard to certain specific embodiments thereof, variations and modifications will become apparent to those skilled in the art. It is the intention that the appended claims be interpreted as broadly as possible in view of the prior art to include all such variations and modifications.

What is claimed:

1. A head protector comprising an elongated, generally flat member for entirely encircling the head of a user having a front portion and a back portion separated by side portions and having an inner and an outer portion when encircling a head, the elongated member being formed of a first inner layer of relatively soft cellular plastic material and a second outer layer of relatively stiffer cellular plastic material, the inner and outer layers together being capable of passing through the protector to the head of the user less than 300 Gs from an impact of approximately 50 joules.

2. A head protector according to claim 1 in which the plastic material of the first inner layer comprises visco-elastic foam having open cells.

3. A head protector according to claim 2 in which the plastic material of the second outer layer comprises closed cell foam.

4. A head protector according to claim 3 in which the open cell plastic material is approximately ½ inch in thickness and the outer layer of plastic is approximately ¼ inch in thickness.

5. A head protector according to claim 2 in which the plastic material is polyurethane foam.

6. A head protector according to claim 5 in which the second outer layer of plastic material is cross-linked polyurethane foam.

7. A head protector according to claim 1 in which the inner, front portion is formed of material less stiff than the inner back portion.

8. A head protector according to claim 1 further including an outer cover of stretchable material placed over the elongated member.

9. A head protector according to claim 5 in which the plastic material is approximately 1 inch in thickness.

10. A head protector according to claim 1 in which the front, back and side portions each have a height extending from bottom to top and a thickness extending from an inside to an outside and the back portion has a greater thickness than the front portion.

11. A head protector according to claim 1 in which the member comprises a single piece forming a continuous loop.

12. A head protector according to claim 1 in which the first inner layer comprises a plurality of open cell, visco-elastic foam resin and the second outer layer comprises cross-linked, closed cell resin attached thereto.

13. A head protector according to claim 1 further comprising a cloth layer disposed on the inside and outside of the member.

14. A head protector according to claim 1 in which the inner layer material comprises a plurality of layers.

15. A head protector according to claim 14 in which the stiffness of at least one layer is different from the stiffness of another layer.

16. A head protector according to claim 1 in which the elongated member comprises at least one piece for entirely encircling the head of a user having opposite ends which mate together to form a respective joint having a selected effective height, the opposite ends formed with respective inversely varying heights so that when formed into an encircling configuration, the effective size of the head protector can be adjusted within a range while maintaining the head of a user entirely encircled and without substantially changing the effective height in the vicinity of the opposite mating ends.

17. A head protector according to claim 16 in which the opposite ends have opposing interfitting, offset steps.

18. A head protector according to claim 16 in which the elongated member comprises two separate intermitting pieces.

19. A head protector according to claim 1 in which the elongated member has a thickness between the inner and outer portions and the elongated member comprises at least one piece for entirely encircling the head of a user having opposite ends which mate together to form a respective joint, the ends having tapered widths so that when formed into an encircling configuration, the effective size of the head protector can be adjusted within a range while maintaining the head of a user entirely encircled and without substantially changing the thickness of the headband in the vicinity of the opposite mating ends.

* * * * *